US008281532B2

(12) United States Patent
Pulte et al.

(10) Patent No.: US 8,281,532 B2
(45) Date of Patent: Oct. 9, 2012

(54) EDGE CLADDING

(75) Inventors: William J. Pulte, Bloomfield Hills, MI (US); Larry Wrass, Chesterfield, MI (US); William M. Harkins, Clarkston, MI (US)

(73) Assignee: PN II, Inc., Bloomfield Hills, MI (US)

( * ) Notice: Subject to any disclaimer, the term of this patent is extended or adjusted under 35 U.S.C. 154(b) by 656 days.

(21) Appl. No.: 11/957,573

(22) Filed: Dec. 17, 2007

(65) Prior Publication Data

US 2009/0049780 A1 Feb. 26, 2009

Related U.S. Application Data

(60) Provisional application No. 60/913,708, filed on Apr. 24, 2007.

(51) Int. Cl.
*B44F 7/00* (2006.01)
*B44F 9/00* (2006.01)
*E04C 1/00* (2006.01)

(52) U.S. Cl. ..... 52/312; 52/204.54; 52/211; 52/287.1

(58) Field of Classification Search ..... 52/204.53, 52/204.56, 204.71, 210, 211, 288.1, 312, 52/204.54, 717.01, 717.03, 717.05, 718.01–718.05, 52/656.4–656.6
See application file for complete search history.

(56) References Cited

U.S. PATENT DOCUMENTS 1,995,764 A * 3/1935 Bohnsack ..... 52/211
3,295,277 A * 1/1967 Potter et al. ..... 52/204.53
3,974,606 A * 8/1976 LaBorde ..... 52/288.1
4,037,900 A * 7/1977 Schmidger ..... 439/216
4,229,844 A * 10/1980 Cribben et al. ..... 52/716.2
4,423,575 A * 1/1984 Lagergren et al. ..... 52/204.53
4,457,119 A * 7/1984 Dahowski ..... 52/300
4,706,426 A * 11/1987 Rumsey ..... 52/232
5,107,551 A * 4/1992 Weir et al. ..... 4/496
5,199,237 A * 4/1993 Juntunen ..... 52/287.1
5,322,582 A 6/1994 Davies et al.
5,324,377 A 6/1994 Davies et al.
5,345,722 A * 9/1994 McKann ..... 49/505
5,660,010 A * 8/1997 Sayers ..... 52/217
6,112,481 A * 9/2000 Schiedegger et al. ..... 52/211
6,132,658 A 10/2000 Davies et al.
6,141,922 A 11/2000 Carlisle et al.
6,197,412 B1 3/2001 Jambois
6,216,406 B1 * 4/2001 Hauser ..... 52/287.1
6,631,595 B1 * 10/2003 Minter ..... 52/212
6,772,560 B2 8/2004 Dischiant et al.
6,872,273 B2 3/2005 Davies et al.
(Continued)

OTHER PUBLICATIONS

Garage Door Trim System, www.royalmouldings.com, May 2008.

*Primary Examiner* — William Gilbert
*Assistant Examiner* — Theodore Adamos
(74) *Attorney, Agent, or Firm* — Dobrusin & Thennisch PC

(57) ABSTRACT

A three-dimensional edge cladding for an architectural opening that includes a forward facing portion having a substantially constant first profile along a longitudinal axis. The forward facing portion includes a plurality of spaced apart nailing flanges, stepped surface topography projecting generally forward and away from the flanges. A longitudinally extending channel receives a side facing portion having a substantially constant second profile that include a portion that is generally orthogonal to the nailing flanges. A joint cover portion for covering the section where two or more edge cladding members meet.

9 Claims, 6 Drawing Sheets

U.S. PATENT DOCUMENTS

| | | | | |
|---|---|---|---|---|
| 7,111,433 | B2 | 9/2006 | Kerscher | |
| 2002/0124485 | A1 | 9/2002 | Pulte | |
| 2004/0250485 | A1 | 12/2004 | Pulte | |
| 2005/0034385 | A1 | 2/2005 | Broad et al. | |
| 2005/0172571 | A1* | 8/2005 | Koenig et al. | 52/718.01 |
| 2006/0075700 | A1 | 4/2006 | Broad et al. | |

* cited by examiner

EDGE CLADDING

CLAIM OF PRIORITY

This application claims priority to U.S. Provisional Application No. 60/913,708 filed on Apr. 24, 2007 and incorporates said Application No. 60/913,708 by reference for all purposes.

FIELD OF THE INVENTION

The invention relates to architectural structures, and more particularly to cover members for protecting, covering and ornamenting architectural openings.

BACKGROUND OF THE INVENTION

Traditionally, residential architectural openings, such as window or door openings, employ flashing members, tapes, or other sealing materials for excluding moisture, creating a weather barrier or otherwise filling gaps that result from rough carpentry. The openings also typically have a building veneer (e.g., siding, masonry, stucco, or otherwise), which require care in installation to avoid undesired visual imperfections, particularly along vertical edges. Edges of such structures not only create a potential for attracting moisture, dirt or other undesirable elements, they are generally not visibly attractive.

Typically construction involves a successive buildup of molding cover members for covering the edges. Particularly when ornate detail is desired for the edge coverings, the coverings require a buildup of a plurality of layers. The layered buildup usually involves the successive use of multiple wood boards, which are solid, susceptible to mold or rot, and/or require periodic painting, staining or some other coating step.

It would be desirable to simplify the construction of edge coverings. It would also be desirable to simplify assembly of such edge coverings. It still would also be desirable to provide an edge covering that is weather-resistant. It still would further be desirable to impart functionality to the edge coverings.

SUMMARY OF THE INVENTION

In its various respects, the present invention meets one or more of the above needs by providing a three-dimensional edge cladding for an architectural opening that includes a forward facing portion having a substantially constant first profile along a longitudinal axis. The forward facing portion includes a first portion that has at least one outboard nailing flange and at least one inboard nailing flange, the outboard and the inboard nailing flanges being spaced apart from each other on opposite sides of the longitudinal axis in a common first plane. The forward facing portion also includes a second portion including an exterior stepped surface topography projecting generally forward and away from the first plane, the stepped surface topography including a plurality of substantially planar exterior wall segments that are generally parallel to the first plane.

A longitudinally extending channel flange is disposed along substantially the entirety of the length of the forward facing portion. The channel flange is generally parallel to one of the substantially planar exterior wall segments and projects from the second portion for defining a receiving channel that extends substantially the entirety of the length of the forward facing portion.

A side facing portion having a substantially constant second profile is adapted to be received in the forward facing portion. The side facing portion includes a first longitudinally extending wall surface segment having a first longitudinal free edge and a second longitudinally extending wall surface segment having a second longitudinal free edge. The first segment and the second segment are disposed generally orthogonally to each other. Desirably, the first longitudinally extending wall surface segment is disposed at least partially within the channel flange along substantially its entire length. Moreover, an open space is defined behind the exterior stepped topography and forward of the first plane.

An apparatus of covering a joint between two or more portions of the cladding assembly. This covering or corner joint facing having a substantially constant profile which may be the same general shape as the profile of adjoining members. Desirably, it is adapted to be received by the forward facing portion and the side facing portion and overlapping at least two three-dimensional edge cladding pieces.

In one preferred embodiment, the forward facing portion and the side facing portion have a substantially constant wall thickness less than about 5 mm throughout the entirety of their profiles. In another embodiment, at least the forward facing portion includes a plurality of substantially continuous longitudinally disposed glass fibers in a thermoset polymeric matrix.

Accordingly, pursuant to one aspect of the present invention, there is contemplated a three-dimensional edge cladding for an architectural opening, comprising a forward facing portion having a substantially constant first profile along a longitudinal axis, and including; a first portion including an outboard nailing flange and an inboard nailing flange, the outboard and the inboard nailing flanges being spaced apart from each other on opposite sides of the longitudinal axis in a common first plane; a second portion including an exterior stepped surface topography projecting generally forward and away from the first plane, the stepped surface topography including a plurality of substantially planar exterior wall segments that are generally parallel to the first plane; a longitudinally extending channel flange disposed along substantially the entirety of the length of the forward facing portion, the channel flange being generally parallel to one of the substantially planar exterior wall segments and projecting from the second portion for defining a receiving channel that extends substantially the entirety of the length of the forward facing portion; a side facing portion having a substantially constant second profile and adapted to be received in the forward facing portion, the side facing portion including a first longitudinally extending wall surface segment having a first longitudinal free edge and a second longitudinally extending wall surface segment having a second longitudinal free edge, the first segment and the second segment being disposed generally orthogonally to each other; wherein the first longitudinally extending wall surface segment is disposed at least partially within the channel flange along substantially its entire length; wherein an open space is defined behind the exterior stepped topography and forward of the first plane; wherein the forward facing portion and the side facing portion have a substantially constant wall thickness less than about 5 mm throughout the entirety of their profiles; and wherein at least the forward facing portion includes a plurality of substantially continuous longitudinally disposed glass fibers in a thermoset polymeric matrix.

The invention may be further characterized by one or any combination of the features described herein, such as the outboard nailing flange is a terminal wall portion. The open space defined behind the exterior stepped topography and forward of the first plane receives at least one element selected from a cable, a cable conduit, a downspout, a gas line, an antenna, or any combination thereof. The nailing flanges are concealed from view after completion of construction. At least the forward facing portion is a pultruded construction. At least the forward facing portion is substantially devoid of any parting line. At least the forward facing portion is devoid of any dimples from molding.

Accordingly, pursuant to another aspect of the present invention, there is contemplated a three-dimensional edge cladding for an architectural opening, comprising a forward facing portion having a substantially constant first profile along a longitudinal axis, and including; a first portion including an outboard nailing flange and an inboard nailing flange, the outboard and the inboard nailing flanges being spaced apart from each other on opposite sides of the longitudinal axis in a common first plane; a second portion including an exterior stepped surface topography projecting generally forward and away from the first plane, the stepped surface topography including a plurality of substantially planar exterior wall segments that are generally parallel to the first plane; a longitudinally extending channel flange disposed along substantially the entirety of the length of the forward facing portion, the channel flange being generally parallel to one of the substantially planar exterior wall segments and projecting from the second portion for defining a receiving channel that extends substantially the entirety of the length of the forward facing portion; a side facing portion having a substantially constant second profile and adapted to be received in the forward facing portion, the side facing portion including a first longitudinally extending wall surface segment having a first longitudinal free edge and a second longitudinally extending wall surface segment having a second longitudinal free edge, the first segment and the second segment being disposed generally orthogonally to each other; wherein the first longitudinally extending wall surface segment is disposed at least partially within the channel flange along substantially its entire length; wherein an open space is defined behind the exterior stepped topography and forward of the first plane; wherein the forward facing portion and the side facing portion have a substantially constant wall thickness less than about 5 mm throughout the entirety of their profiles; and wherein at least the forward facing portion includes a plurality of substantially continuous longitudinally disposed glass fibers in a thermoset polymeric matrix; and a corner joint facing portion having a substantially constant third profile and adapted to be received by the forward facing portion and the side facing portion and overlapping at least two of the three-dimensional edge cladding pieces; the corner joint facing portion including a first joint longitudinally extending wall surface having a first joint longitudinal free edge, wherein the first longitudinal extending wall surface is mated to the second longitudinally extending wall surface segment; a second joint longitudinally extending wall surface segment having at least one down turned flange segment generally parallel to the corner joint facing portion for fitting in between the planar exterior wall segments and an exterior veneer.

Accordingly, pursuant to yet another aspect of the present invention, there is contemplated a three-dimensional edge cladding for an architectural opening, comprising a forward facing portion having a substantially constant first profile along a longitudinal axis, and including; a first portion including an outboard nailing flange and an inboard nailing flange, the outboard and the inboard nailing flanges being spaced apart from each other on opposite sides of the longitudinal axis in a common first plane; a second portion including an exterior stepped surface topography projecting generally forward and away from the first plane, the stepped surface topography including a plurality of substantially planar exterior wall segments that are generally parallel to the first plane; a longitudinally extending channel flange disposed along substantially the entirety of the length of the forward facing portion, the channel flange being generally parallel to one of the substantially planar exterior wall segments and projecting from the second portion for defining a receiving channel that extends substantially the entirety of the length of the forward facing portion; a side facing portion having a substantially constant second profile and adapted to be received in the forward facing portion, the side facing portion including a first longitudinally extending wall surface segment having a first longitudinal free edge and a second longitudinally extending wall surface segment having a second longitudinal free edge, the first segment and the second segment being disposed generally orthogonally to each other; wherein the first longitudinally extending wall surface segment is disposed at least partially within the channel flange along substantially its entire length; wherein an open space is defined behind the exterior stepped topography and forward of the first plane; wherein the forward facing portion and the side facing portion have a substantially constant wall thickness less than about 5 mm throughout the entirety of their profiles; and wherein at least the forward facing portion includes a plurality of substantially continuous longitudinally disposed glass fibers in a thermoset polymeric matrix; and a corner joint facing portion having a substantially constant third profile and adapted to be received by the forward facing portion and the side facing portion and overlapping at least two of the three-dimensional edge cladding pieces; the corner joint facing portion including a first joint longitudinally extending wall surface having a first joint longitudinal free edge, wherein the first longitudinal extending wall surface is mated to the second longitudinally extending wall surface segment; a second joint longitudinally extending wall surface segment.

DETAILED DESCRIPTION OF THE INVENTION

Figure 1:
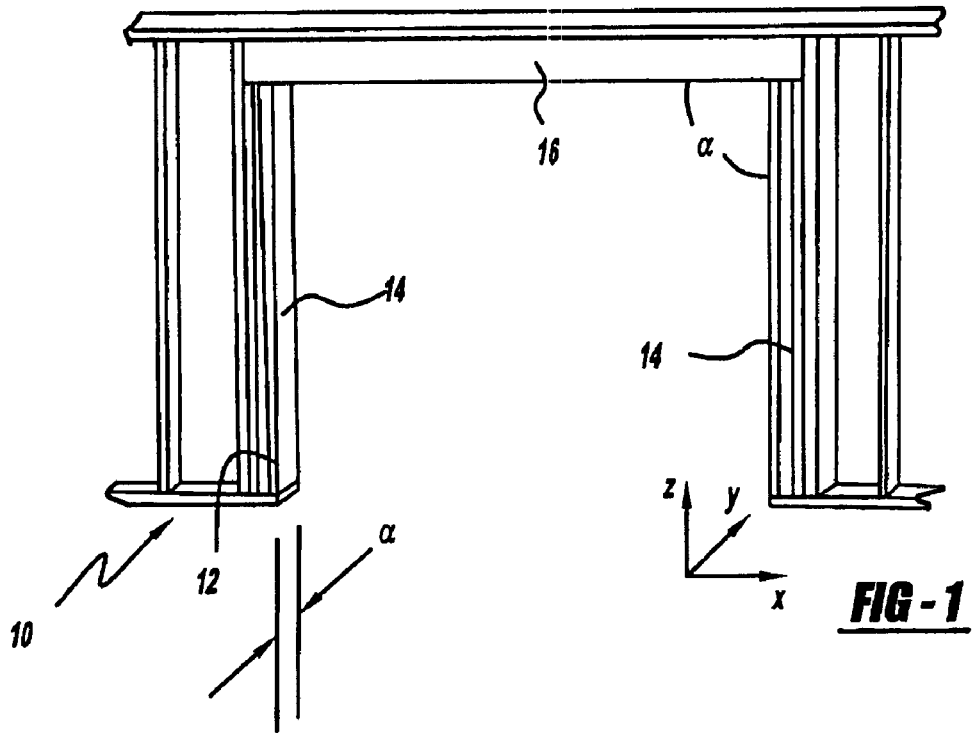
FIG. 1 illustrates an example of rough carpentry of an architectural opening
Figure 2:
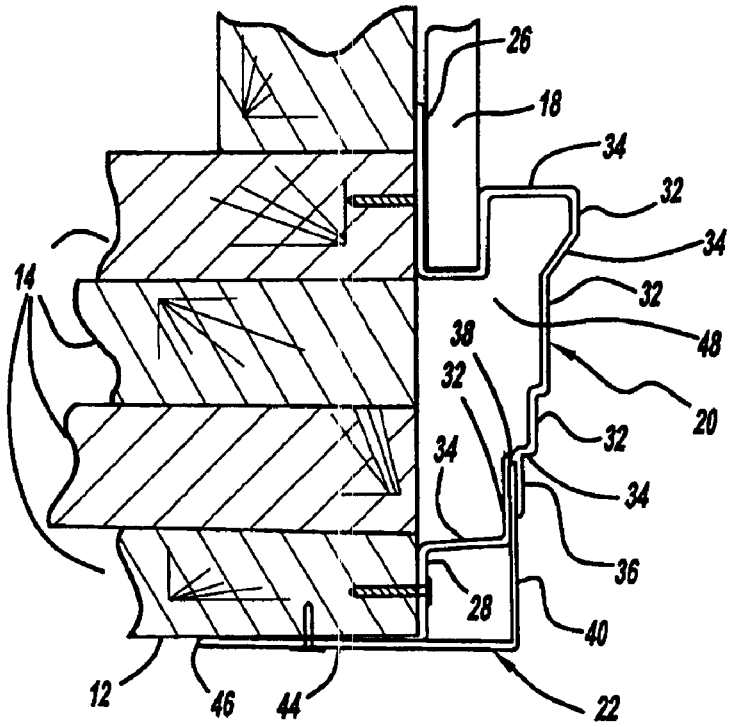
FIG. 2 is a side sectional view of an installed assembly in accordance with the present invention.

In general, the present invention pertains to edge cladding, and particularly for use in architectural structures for covering joints. In one aspect, the edge cladding comprises two separate covering pieces that are joined together when installed on a structure for defining an edge cladding assembly. In a particular aspect, the assemblies herein are employed for concealing a rough opening that defines a window, a door, a portico, or some other architectural opening. In general the architectural openings will be defined as shown in FIGS. 1 and 2 to include at least one wall frame portion 10 that terminates at an edge 12 adjoining at least one support frame member 14 (e.g., two opposing spaced apart members). The support frame member typically has a depth (d) of at least about 5 cm, more specifically at least about 10 cm, and still more specifically at least about 15 cm. A lateral cross member 16 (e.g., a header) typically will meet at least one of the vertical support frame members at an angle (e.g., generally orthogonally, at an angle ($\alpha$) greater than about 90 degrees, or a combination thereof will span and bridge between the opposing spaced apart frame members 14. The lateral cross frame member will generally include substantially straight portions, but may include one or more arcuate portions (e.g., for defining an arch). The lateral cross frame member typically has a depth (d) of at least about 5 cm, more specifically at least about 10 cm, and still more specifically at least about 15 cm.

It is expected for assemblies herein that the wall includes an exterior veneer 18, such as brick, siding, paneling, stone, tile, molding, block, any combination thereof or the like. The veneer typically will have a depth in the range of about 1 to about 10 cm or more. The veneer will generally adjoin at least one of the vertical support frame member, the lateral cross frame member or both. The edge cladding herein is particularly suitable for covering the vicinity of the locations where the veneer adjoins any vertical support frame member, any lateral support frame member or both. By virtue of the thin walled construction of the edge cladding assemblies herein, there is also advantageously provided a gap between the cladding and the underlying architectural structure. The gap affords the possibility site for locating one or more of a cable, a conduit, a drain, insulation, or any combination thereof.

Figure 3:
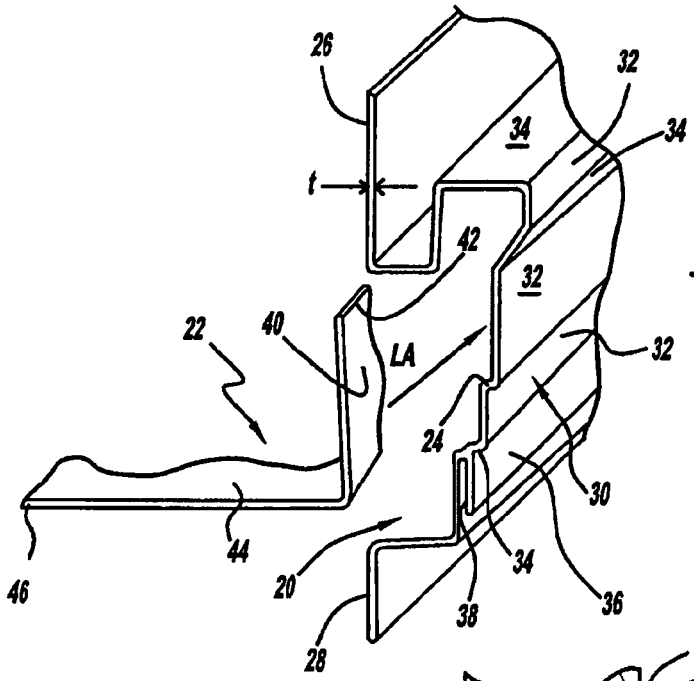
FIG. 3 is a perspective view of the portions of one assembly of the present invention.

Turning now to FIGS. 2 and 3, there is illustrated an example of one possible cladding assembly for use according to the present teachings. The cladding is generally three-dimensional, in the sense that it is configured for covering surfaces in at least each of the x, y and z orthogonal axes. The cladding will commonly include at least two portions that are fabricated independent of each other (and possibly even of dissimilar materials), and are thereafter assembled for completing the assembly. For example, it is contemplated to employ a forward facing portion 20, a side facing portion 22, and a corner portion. More specifically, as seen in FIGS. 2 and 3, the forward facing portion 20 has a substantially constant first profile along a longitudinal axis (LA). The forward facing portion 20 includes a first portion 24 that has at least one outboard nailing flange 26 and at least one inboard nailing flange 28, the outboard and the inboard nailing flanges being spaced apart from each other on opposite sides of the longitudinal axis in a common first plane. The forward facing portion 20 also includes a second portion 30 including an exterior stepped surface topography projecting generally forward and away from the first plane, the stepped surface topography including a plurality of exterior wall segments 32 (e.g., segments that are substantially planar, arcuate or both) that have at least a portion disposed generally opposite (e.g., substantially parallel to) the first plane, and adjoining wall segments 34 (e.g., segments that are substantially planar, arcuate or both) that have at least a portion disposed generally at an angle (e.g., substantially orthogonally to) relative to the first plane. Optionally, one or more of the wall segments may have an opening formed therein. For example, the wall segment 34 adjoining the nailing flange 28 might have one or more openings for affording access to the region behind the forward facing portion 20. When the assembly is assembled, the opening is thereby concealed.

It should be appreciated that the term "nailing flange" as employed herein does not foreclose the use of other forms of attachment. For example, a nailing flange may be attached to an underlying structure by one or any combination of attachments such as nails, screws, staples, rivets, adhesive, hook and loop fastener, pin, or otherwise.

As seen in FIGS. 2 and 3, a longitudinally extending channel flange 36 is disposed along substantially the entirety of the length of the forward facing portion 20. The channel flange 36 is generally parallel to one of the substantially planar exterior wall segments 34 and projects from the second portion 30 for defining a receiving channel 38. Desirably, the receiving channel will extend substantially the entirety of the length of the forward facing portion 20.

The side facing portion 22 generally will have a substantially constant second profile. One preferred approach is to configure the side facing portion so that is capable of being received in the forward facing portion 20, such as in the receiving channel 38. The side facing portion 22 is configured for defining an outwardly (e.g., sideways) facing outer wall surface. For example, a first longitudinally extending wall surface segment 40 may have a first longitudinal free edge 42. A second longitudinally extending wall surface segment 44 may have a second longitudinal free edge 46. The first segment 40 and the second segment 42 are disposed generally at an angle (e.g., substantially orthogonally) to each other. Desirably, the first longitudinally extending wall surface segment is disposed at least partially within the channel flange 36 along substantially its entire length. Moreover, an open space 48 is defined behind the exterior stepped topography and forward of the first plane.

Figure 4:
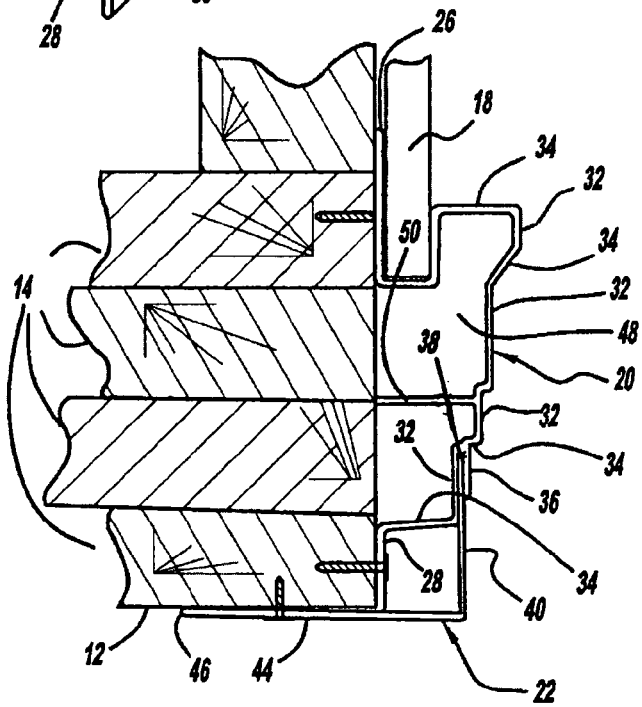
FIG. 4 is a side sectional view of an installed assembly in accordance with the present invention configured to include concealed components.
Figure 5:
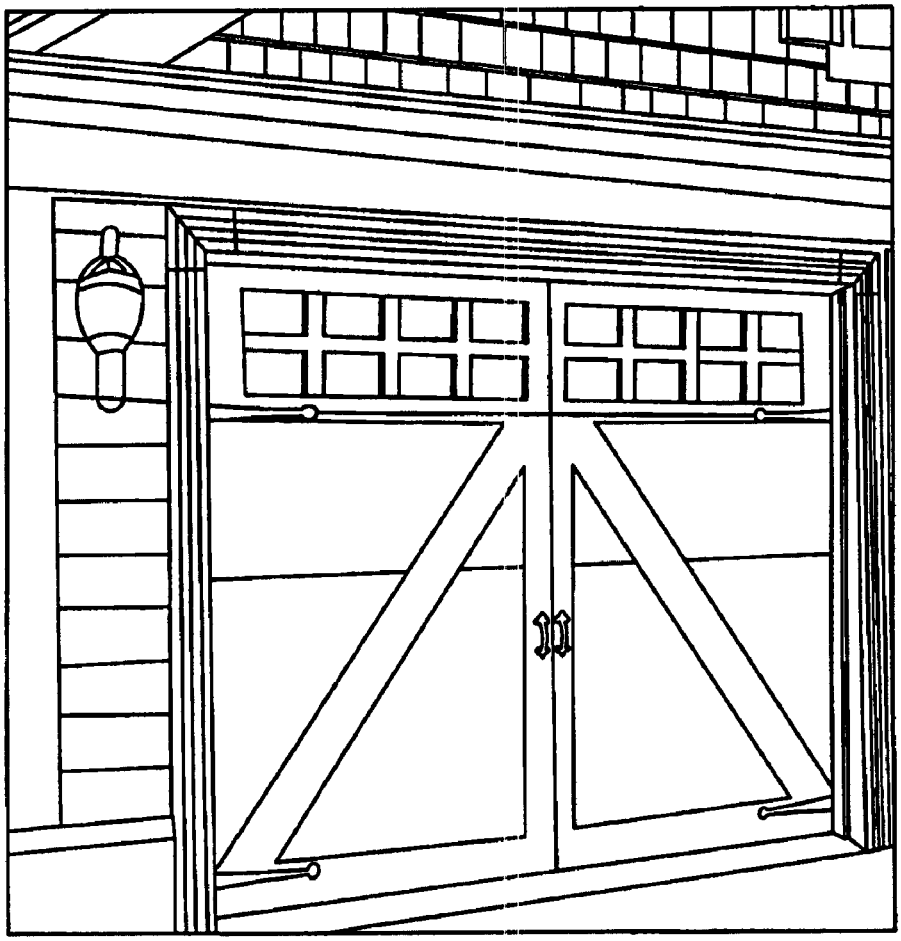
FIG. 5 is an example of a garage door assembly that includes the edge cladding of the present invention.
Figure 6:
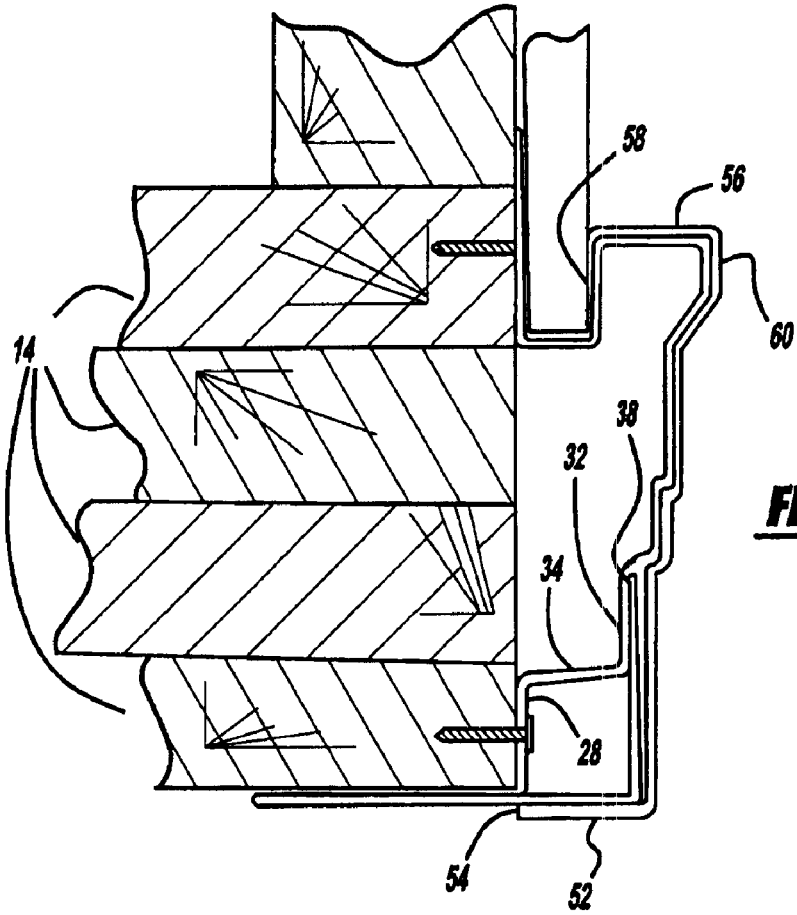
FIG. 6 is a side sectional view of an installed assembly in accordance with the present invention.
Figure 7:
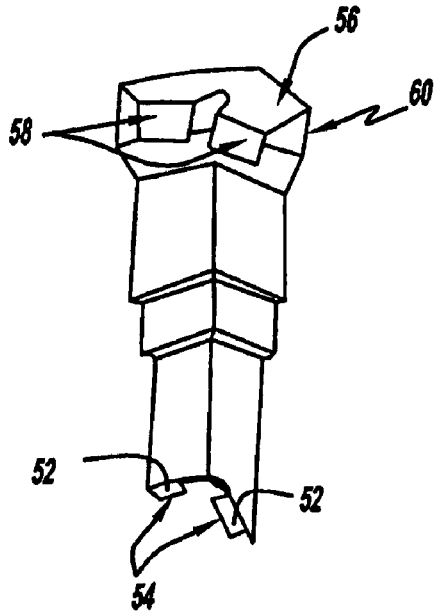
FIG. 7 is an illustrative perspective view of one example of the corner joint piece of the present invention.
Figure 8:
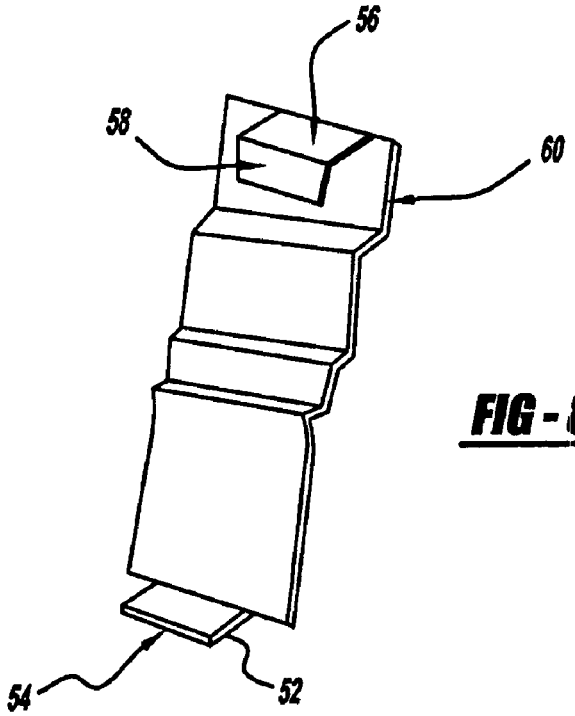
FIG. 8 is an illustrative perspective view of a second example of the corner joint piece of the present invention.
Figure 9:
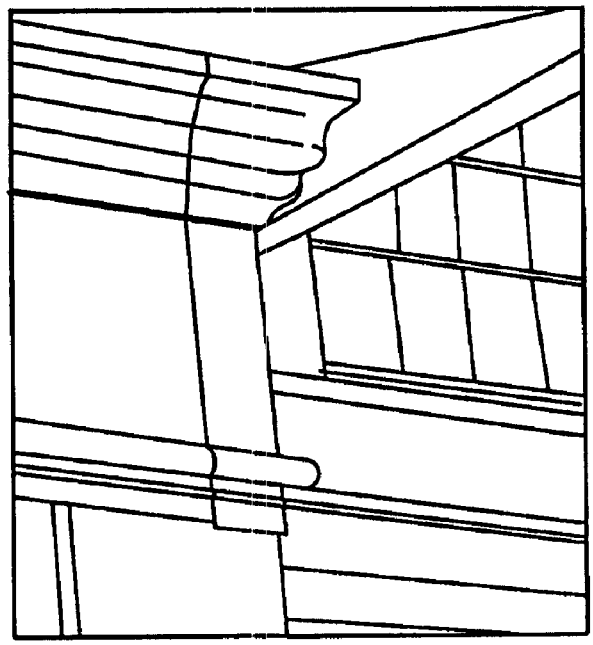
FIG. 9 is an example of a 90° type corner joint piece that includes the edge cladding of the present invention.

As seen in FIG. 4, the invention herein also contemplates dividing the open space into two or more chambers, such as by forming one or more partition walls 50. Consistent with the above discussion, one or more of the chambers can be used for locating one or more of a cable, a conduit, a drain, insulation, or any combination thereof.

The wall surface segment 44 may be installed so that it contacts the nailing flange 28, or it may be spaced from the free end of the nailing flange. The wall surface segment 44 is mechanically affixed to at least one support frame member 14, preferably by driving a fastener through the segment 44 into the member 14 (e.g. nailing or screwing). Optionally, the wall surface segment 44 is affixed to at least one support frame member 14 by an adhesive means where an adhesive is disposed between at least a portion of the wall surface segment 44 and the frame member 14. Desirably, the wall thickness of the first longitudinally extending wall surface segment 40 will be about the same thickness as the width of the channel 38. The spacing of the channel flange 36 relative to opposing wall segment 32 will preferably be sufficient for allowing a friction fit of the first longitudinally extending wall surface segment 40 within the channel. Of course, it may also be larger than the thickness of the first longitudinally extending wall surface segment 40.

It is seen that the channel 38 is defined within the forward facing portion 20. It is possible that it is formed as part of the side facing portion 22 instead, by similar structure as that defining the channel 38. A combination of multiple channels may also be employed (e.g., a channel defined by similar structure as that defining the channel 38 formed in the side facing portion in addition to the channel 38). Further, it may be possible that a nailing flange is located on the side facing portion 22, instead of on the forward facing portion. In this regard, it may also be possible that the inboard nailing flange 28 wraps around the edge of the structure so that it is in a plane generally parallel with the plane of one or more of the wall segments 34.

The walls defining the portions of the cladding assembly are generally to have a relatively thin-walled structure. For example, in one preferred embodiment, the forward facing portion and the side facing portion have a substantially constant wall thickness (t) less than about 10 mm, more specifically less than about 7 mm and still more specifically less than about 4 mm (e.g., about 2 mm), throughout the entirety of their profiles.

As seen in FIG. 6 through FIG. 10, the invention herein also contemplates an apparatus of covering a joint between two or more portions of the cladding assembly. The portions of the cladding assembly may be configured such that the joint between them is generally parallel (e.g. butt joint, see FIG. 8) or at any angle (e.g. 90° corner joint where cladding is on generally perpendicular planes, see FIGS. 7 and 9; 90° corner joint where cladding is on generally parallel planes, see FIG. 10) and the covering is constructed to generally match any of the joint angles. Such apparatus is not limited to the cladding assembly herein but can also be employed for covering joints of two or more cornice members, such as the cornice members described in Published U.S. Application No. 20020124485 (Pulte: Pultruded Trim Members), incorporated by reference.

In one embodiment, this covering or corner joint facing 60 having a substantially constant profile which may be the same general shape as the profile of adjoining members and adapted to be received by the forward facing portion 20 and the side facing portion 22 and overlapping at least two three-dimensional edge cladding pieces. The corner joint facing portion include a first joint longitudinally extending wall surface 52 having a first joint longitudinal free edge 54, wherein the first longitudinal extending wall surface 52 is mated and is generally parallel to the second longitudinally extending wall surface segment 44. A second joint longitudinally extending wall surface 56 having at least one down turned flange segment 58, generally parallel to the corner joint facing portion for fitting in between the planar exterior wall segments and an exterior veneer 18 and its length is less than (in a generally vertical direction) the vertical depth of the inboard nailing channel. The down turned flange segment 58 generally is deposed along a substantial portion of length of the second joint longitudinally extending wall surface 56.

The corner joint facing in the first embodiment is installed by the steps of: (1) mating the down turned flange 58 to the outside wall of the inboard nailing flange of the adjoining members; (2) rotating the entire corner joint piece until the first joint longitudinally extending wall surface 52 and the first joint longitudinal free edge 54 mate with the side facing portions 22 of the cladding assembly; (3) The corner joint piece is secured in place by a friction fit, or more preferably a securing means (e.g. adhesive or mechanical fastener).

Figure 10:
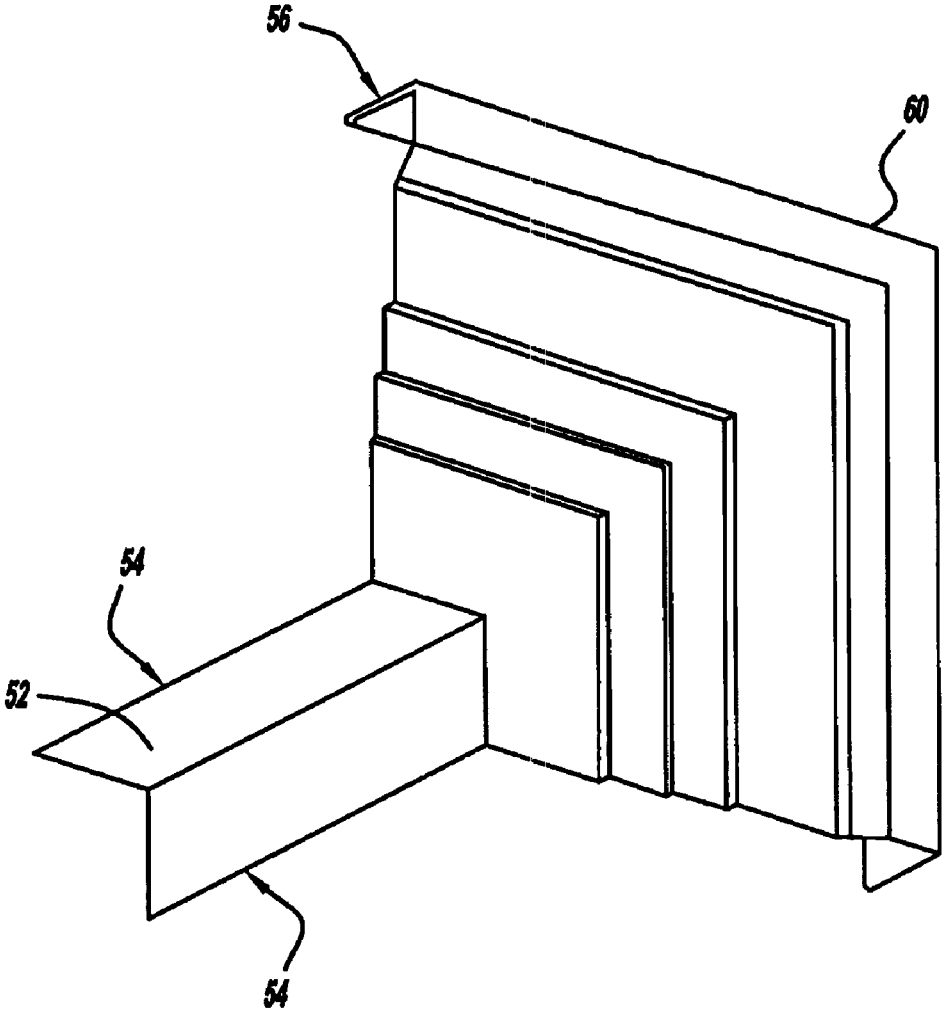
FIG. 10 is an illustrative perspective view of another example of the corner joint piece of the present invention.

In a second embodiment, see FIG. 10, this covering or corner joint facing 60 having a substantially constant profile which may be the same general shape as the profile of adjoining members and adapted to be received by the forward facing portion 20 and the side facing portion 22 and overlapping at least two three-dimensional edge cladding pieces. The corner joint facing portion include a first joint longitudinally extending wall surface 52 having a first joint longitudinal free edge 54, wherein the first longitudinal extending wall surface 52 is mated and is generally parallel to the second longitudinally extending wall surface segment 44. A second joint longitudinally extending wall surface 56.

The materials of the forward facing portion, the side facing portion and the corner joint facing portion may be the same or different relative to each other. One approach employs the use of a plastic material, and more specifically a fiber reinforced plastic for one or both of the portions. For example, either or both of the portions 20 and 22, and particularly at least the forward facing portion 20 includes a plurality of substantially continuous longitudinally disposed fibers (such as a fiber selected from glass (e.g., E-glass, A-Glass, S-Glass, or any combination thereof), aramid, carbon, natural fiber, thermoplastic polymeric material, or any combination thereof) in a polymeric matrix, and particularly a thermoset polymeric matrix. It is not necessary that the fibers all be longitudinally disposed; it is possible the fibers may be longitudinally and transversely disposed. Thus fibers can be provided as a weave, in a mat, as a random dispersion or any combination of orientations. See, e.g., U.S. Pat. No. 6,881,288 (Davies et al); U.S. Pat. No. 6,872,273 (Davies et al); and U.S. Pat. No. 5,324,377 (Davies) incorporated by reference. Further, it is possible that the polymeric matrix material may include two or more different resins, e.g., so as to provide localized regions of one of the resins, in accordance with teachings such as U.S. Pat. No. 5,322,582 (Davies et al).

Fibers herein may be optionally treated for improving wetting of the resin on the fibers, such as by contacting them with a suitable surfactant or wetting agent.

The cover portions and corner joint facing portions can be manufactured by a number of processes and from a variety of materials. The cover portions and corner joint facing portions can be fabricated using vacuum forming techniques, injection molding, extrusion, compression molding, or other any other type of plastic formation techniques. One preferred approach to the manufacture of such portions is pultrusion, in accordance with the teachings in Published U.S. Application No. 20020124485 (Pulte: Pultruded Trim Members), incorporated by reference. For the manufacture of such articles, in general, pultrusion typically will involve a continuous process by which glass fibers (e.g., in the form of a bundle) are pulled through an uncured resin, such as for impregnating the fiber bundle and/or saturating the fibers with the resin, and then through a die (e.g., a heated die) where the resin is cured, such as for crosslinking the resin to form a thermoset fiber reinforced plastic. Any suitable resin type may be used, such as (without limitation) polyester (e.g., orthophthalic, isophthalic or a combination), polyurethane, a vinyl ester, epoxy, or any combination thereof.

It is possible to employ materials such as steel, aluminum, vinyl, or wood for the assemblies herein. However, desirably, the material selected will exhibit a thermal insulation properties that are at least 100, 200, 400, or even 800 times higher than metals (e.g., at least 150 times that of steel, and/or at least 600 times greater than aluminum). The material selected will be generally resistant to destruction by termites, carpenter ants or other insects seeking to feed from the material. The material exhibits less than about 30% and more specifically less than about 15% of the thermal expansion and contraction of vinyl, and less than about 60% or more specifically less than about 40% the thermal expansion and contraction of aluminum. Additionally, the material selected generally will accept a paint (possibly even without an underlying primer), will be generally resistant to oxidation and corrosion or both.

Examples of ranges of properties include the following:

Linear Coefficient of Thermal Expansion (cm/cm/° C.× $10^{-6}$) (Per ASTM D696): less than about 20, more specifically less than about 15 (e.g., about 5 to about 12)

Longitudinal Flexural Modulus (GPa)(Per ASTM D790): at least about 5 GPa, more specifically at least about 10 GPa, and still more specifically at least about 20 GPa (e.g., about 5 to about 50 GPa).

Longitudinal Tensile Strength (MPa)(Per ASTM D638): at least about 150 MPa, and more specifically at least about 250 MPa, and still more preferably at least about 350 MPa. It is possible that the tensile strength may exceed 1000 MPa.

Specific Gravity ($g/cm^3$)(Per ASTM D792): about 1.8 to about 2.1.

The amount of the fiber in the pultruded parts herein will generally range from about 10 to about 95 percent by weight of the part, and more specifically about 20 to about 90 percent by weight of the part, and still more specifically about 25 to about 50 percent by weight (e.g., about 28 to about 42 percent by weight) of the part.

The forward facing portion shown in FIG. 2 attaches to the outer surface of an architectural structure generally along an edge opening for a door, window or other opening. The nailing flanges are generally brought into contact with an underlying wall surface, frame member or both and attached thereto by mechanical fastening, adhering, a combination thereof or otherwise. The side facing portion is inserted so that it resides at least partially within the channel flange. The veneer can be installed so that it at least partially overlaps with the outboard nailing flange. The veneer thus conceals any mounting hardware used to attach the nail flange. Optionally, an adhesive (e.g., an epoxy-based adhesive, an acrylic-based adhesive, a urethane-based adhesive, a polyester-based adhesive or any combination thereof) may be employed within the channel 38 for joining the portions.

Either or both of the forward or side facing portions may also be adapted to carry or conceal an insulation and/or sealing material or structure. For example, along at least a portion of the length, of the forward or side facing portions there may be insulation attached to the portion, lining the portion and/or concealed within the gap between the portion and the underlying frame member to the interior wall of the members. The insulation can be made up of a variety of materials including blanket type insulation made of fiberglass or rock wool, a spray applied polyurethane foam, a rigid insulation of extruded polystyrene foam, expanded polystyrene foam, polyurethane foam, or polyisocyanurate foam; reflective systems such as foil-faced paper, foil-faced polyethylene bubbles, foil-faced plastic film, or foil-faced cardboard. The insulation can be attached to the cover members by use of an adhesive, spray coating, or any other means for attaching. If desired, the insulating material can be thick enough to fill any gaps between the cover members and the structure providing additional support to the cover members and also serving as a seal between the cover pieces, and the architectural structure against water and air. The use of a compressible foam like insulator as a backing to the cover pieces allows for a better seal against an irregular architectural structure surface and also compensates for any gaps that may form between the cover pieces and the architectural surfaces as a result of temperature changes and differing coefficients of thermal expansion of the building materials. Additionally, an adhesive can be applied on the region of the insulator in contact with the architectural structure strengthening the attachment of the cover member to the structure.

In general, the edge cladding herein will serve as a protective barrier between the frame and underlying building structure and the outside environment, effectively shielding the joints, and sealing them from exposure to adverse environmental elements. The cover members serve to protect the underlying surface structure from harmful elements such as UV radiation, direct sunlight, rain, snow, sleet, hail, moisture, and insects. Therefore, for many applications, it is important that the cladding portions be made of materials that can withstand exposure to such harmful and destructive conditions. The pultruded materials, particularly those made with thermoset polymeric materials, provide good weatherability characteristics.

The materials of one or more of the cladding portions may have a pigment or colorant incorporated directly into the resin, the materials may be coated subsequent to curing of the resin, or a combination thereof. One approach is to apply one or more coats of primer to one or more of the cladding portions, and then apply one or more coats of paint (e.g., a water based paint). Optionally, paint is applied directly to at least one of the cladding portions in the absence of primer. The coating may be applied for achieving a surface finish selected from flat, matte, satin, gloss, or any combination thereof. The surface finish may be applied over all or only a part of the underlying cladding portions.

The resin, or any coating thereof may also include an anti-static agent for reducing or substantially eliminating build-up of static electricity. Examples of such agents include one or more agents based on amines, quaternary ammonium salts, acid esters, metal oxides or salts, or any combination thereof. Other ingredients that might be employed in the materials used for making the cladding of the invention include an impact modifier (e.g., a thermoplastic elastomer, a thermoset elastomer or a combination thereof). One or more fillers may be included such as those having an average grain size of less than about 10 microns, or even less than about 1 micron (e.g., about 10 to about 100 nm). Examples of fillers may include one or more of calcium carbonate, talc, wollastonite, ground aramid, glass spheres, clay, quartz, milled glass, carbon fibers, or any combination thereof. A flame retardant (e.g., a halogenated hydrocarbon, a phosphorus-containing compound, an inorganic flame retardant, or any combination thereof) may be employed. An ultraviolet stabilizer may be employed.

The surface of one or more of the cladding portions may be processed in a suitable technique for imparting a predetermined surface texture, surface pattern, or both. For example, one approach is to subject a cladding portion, while it is being manufactured (particularly during curing or before the material has hardened) to the application of a pressure from a die. Another approach may be to mechanically engrave, laser engrave, or both, a desired texture. For example, one approach may be to process an exposed surface of a cladding portion to give the appearance of a wood grain. For example, during a step of pultruding and prior to entering a die, the resin may be contacted with a strip carrying male projections of different depths and dimensions to form a simulated wood grain pattern, according to the teachings of U.S. Pat. No. 6,132,658 (Davies), incorporated by reference.

One particularly attractive feature of the invention is that the employment of plural cladding portions permits the practice of steps by a user of customizing an appearance of the cladding, replacing worn or damaged portions without needing to replace entire assemblies, imparting or modifying specific functional characteristics to the assemblies, or any combination thereof. The invention thus contemplates the practice of such steps. It is possible that the side facing portion, the forward facing portion, or both may be offered among a selection of similarly dimensioned, interchangeable components. A user who desires to change the appearance, functionality, and/or repair a portion thus separates the portions, and inserts a new portion in place of any removed portion. By way of example, one approach may be to initially employ forward and side facing portions that have the same surface finish and color. Thereafter, one of the portions is removed and is replaced with another portion that is of a same or different material as the removed portion, and has the same or different surface finish and/or color. Examples of such portion selections may include a metal sheet (e.g., a stamped or roll-formed sheet, such as a copper sheet), a metal foil (e.g., a copper foil) laminated to a substrate (e.g., a plastic substrate), a painted plastic, a wood veneer panel, a cork, a ceramic, a stone, a woven fiber, or otherwise. For portions that include a plurality of materials or layers, one or more of the layers may be inlayed so as to create an appearance of a peripheral border, they may be substantially coextensive with an underlying substrate, or a combination thereof. It is also possible that a film is applied to one or more of the cladding portions (e.g. a thermoplastic film, or otherwise in accordance with the teachings of U.S. Pat. No. 6,197,412 (Jambois), incorporated by reference).

Either or both of the cladding portions may include one or more portions that are flat, arcuate, corrugated, patterned, continuous, perforated, channeled, slotted, otherwise opened, smooth, textured, or any combination therein.

The invention also contemplates the assembly of an architectural structure that includes the edge cladding described herein, and also includes a pultruded cornice assembly as described in Published U.S. Application No. 20020124485 (Pulte: Pultruded Trim Members), incorporated by reference. It is also possible that the teachings of Published U.S. Application No. 20040250485 (Pulte: Universal Rake-Ridge Cap), incorporated by reference, may be employed herein as well. For example, it is possible to employ universal-type caps that cover joints of the cladding herein, where the caps are configured to have a back side surface including indicia for demarking one or more guide lines for trimming, where the caps have a surface configuration (e.g., a stepped structure) that intersects with one or more of the underlying cladding portions, or both.

It is also contemplated that the cladding herein will be employed for an opening in which the opening includes a polymeric flashing of the type described in Published U.S. Application No. 20050034385 and 20060075700 (Broad et al. Window Sill Flashing), incorporated by reference. Thus, one approach contemplates a flashing (that may be below about 3 mm, or even below about 1.5 mm in thickness (e.g., about 0.3 to about 0.9 mm) that includes a base, at least one side flange extending from a side edges of the base, with the side flange includes a front surface, and wherein the side flange is substantially perpendicular to the base. A rear wall may project upwardly from a rear edge of the base. A window assembly is assembled to include the flashing at a lower end. An exterior veneer is applied to substantially adjoin the window assembly and the cladding herein is installed to cover any resulting exposed underlying structure.

Any of a number of accessories or optional features may be employed for improving the appearance, functionality or ease of installation of the cladding herein. For example, components may be previously cut to a pre-determined dimension; they may have openings previously formed therein (e.g., an opening for installing a switch, an outlet, an access panel, a keypad, an alarm system component, a light, an address, any combination or otherwise); they may have indicia for demarking one or more guide lines for trimming and/or locating; they may have one or more leveling indicators; they may have weather stripping applied thereto, or any combination thereof.

Any cladding, replacement cladding, or accessories useful therewith may be offered in a retail store (e.g., a hardware store, such as a big box hardware store), through a building materials supply center, through a wholesale distributor, via a catalog, over the Internet, or any combination thereof.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. The use of "a" or "an" is not intended to limit the described subject to a single quantity, but may also denote a plurality of such feature. It will also be appreciated from the above that the fabrication of the unique structures herein and the operation thereof also constitute methods in accordance with the present invention.

Various aspects of the teachings herein are not confined to the preferred edge cladding embodiment shown. It is possible that such aspects may be adapted for use in the manufacture of pultruded cornice assemblies, such as the assemblies described in Published U.S. Application No. 20020124485 (Pulte: Pultruded Trim Members). For example, the present teachings contemplate pultruded cornice assemblies (and the methods of making the same) that may include one or more of the features disclosed herein, such as the materials, any ingredient specified, coating, any laminate covering, the use of adhesive for joints, the incorporation of functional features (e.g., a cable, a cable conduit, a downspout, a gas line, an antenna, or otherwise), the use of insulation behind a wall, any features for improving the appearance, functionality or ease of installation (e.g., an opening for installing a switch, an outlet, an access panel, a keypad, an alarm system component, a light, an address, indicia for demarking one or more guide lines for trimming and/or locating, one or more leveling indicators, weather stripping, or any combination thereof), or any combination thereof.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed:

1. A three-dimensional edge cladding for an architectural opening, comprising:

a) a forward facing portion having a substantially constant first profile along a longitudinal axis, and including;

i) a first portion including an outboard nailing flange and an inboard nailing flange, the outboard and the inboard nailing flanges being spaced apart from each other on opposite sides of the longitudinal axis in a common first plane;

ii) a second portion including an exterior stepped surface topography projecting generally forward and away from the first plane, the stepped surface topography including a plurality of substantially planar exterior wall segments that are generally parallel to the first plane;

iii) a longitudinally extending channel flange disposed along substantially the entirety of the length of the forward facing portion, the channel flange being generally parallel to one of the substantially planar exterior wall segments and projecting from the second portion for defining a receiving channel that extends substantially the entirety of the length of the forward facing portion;

b) a side facing portion having a substantially constant second profile and adapted to be received in the forward facing portion, the side facing portion including a first longitudinally extending wall surface segment having a first longitudinal free edge and a second longitudinally extending wall surface segment having a second longitudinal free edge, the first segment and the second segment being disposed generally orthogonally to each other and the second segment being in planar contact with a terminating edge of a wall frame portion to create a nailing surface that is perpendicular to the outboard nailing flange and inboard nailing flange;

wherein the first longitudinally extending wall surface segment is disposed at least partially within the channel flange along substantially its entire length;

wherein an open space is defined behind the exterior stepped topography and forward of the first plane;

wherein the forward facing portion and the side facing portion have a substantially constant wall thickness less than about 5 mm throughout the entirety of their profiles; and wherein at least the forward facing portion includes a plurality of substantially continuous longitudinally disposed glass fibers in a thermoset polymeric matrix.

2. The edge cladding of claim 1, wherein the outboard nailing flange is a terminal wall portion.

3. The edge cladding of claim 1, wherein the open space defined behind the exterior stepped topography and forward of the first plane receives at least one element selected from a cable, a cable conduit, a downspout, a gas line, an antenna, or any combination thereof.

4. The edge cladding of claim 1, wherein the nailing flanges are concealed from view after completion of construction.

5. The edge cladding of claim 1, wherein at least the forward facing portion is a pultruded construction.

6. The edge cladding of claim 1, wherein at least the forward facing portion is substantially devoid of any parting line.

7. The edge cladding of claim 1, wherein at least the forward facing portion is devoid of any dimples from molding.

8. A three-dimensional edge cladding for an architectural opening, comprising:

a) a forward facing portion having a substantially constant first profile along a longitudinal axis, and including;

i) a first portion including an outboard nailing flange and an inboard nailing flange, the outboard and the inboard nailing flanges being spaced apart from each other on opposite sides of the longitudinal axis in a common first plane;

ii) a second portion including an exterior stepped surface topography projecting generally forward and away from the first plane, the stepped surface topography including a plurality of substantially planar exterior wall segments that are generally parallel to the first plane;

iii) a longitudinally extending channel flange disposed along substantially the entirety of the length of the forward facing portion, the channel flange being generally parallel to one of the substantially planar exterior wall segments and projecting from the second portion for defining a receiving channel that extends substantially the entirety of the length of the forward facing portion;

b) a side facing portion having a substantially constant second profile and adapted to be received in the forward facing portion, the side facing portion including a first longitudinally extending wall surface segment having a first longitudinal free edge and a second longitudinally extending wall surface segment having a second longitudinal free edge, the first segment and the second segment being disposed generally orthogonally to each other and the second segment being in planar contact with a terminating edge of a wall frame portion to create a nailing surface that is perpendicular to the outboard nailing flange and inboard nailing flange;

wherein the first longitudinally extending wall surface segment is disposed at least partially within the channel flange along substantially its entire length;

wherein an open space is defined behind the exterior stepped topography and forward of the first plane;

wherein the forward facing portion and the side facing portion have a substantially constant wall thickness less than about 5 mm throughout the entirety of their profiles; and wherein at least the forward facing portion includes a plurality of substantially continuous longitudinally disposed glass fibers in a thermoset polymeric matrix; and c) a corner joint facing portion having a substantially constant third profile and adapted to be received by the forward facing portion and the side facing portion and overlapping at least two of the three-dimensional edge cladding pieces;

i) the corner joint facing portion including a first joint longitudinally extending wall surface having a first joint longitudinal free edge, wherein the first longitudinal extending wall surface is mated to the second longitudinally extending wall surface segment;

ii) a second joint longitudinally extending wall surface segment having at least one down turned flange segment generally parallel to the corner joint facing portion for fitting in between the planar exterior wall segments and an exterior veneer.

9. A three-dimensional edge cladding for an architectural opening, comprising:

a) a forward facing portion having a substantially constant first profile along a longitudinal axis, and including;

i) a first portion including an outboard nailing flange and an inboard nailing flange, the outboard and the inboard nailing flanges being spaced apart from each other on opposite sides of the longitudinal axis in a common first plane;

ii) a second portion including an exterior stepped surface topography projecting generally forward and away from the first plane, the stepped surface topography including a plurality of substantially planar exterior wall segments that are generally parallel to the first plane;

iii) a longitudinally extending channel flange disposed along substantially the entirety of the length of the forward facing portion, the channel flange being generally parallel to one of the substantially planar exterior wall segments and projecting from the second portion for defining a receiving channel that extends substantially the entirety of the length of the forward facing portion;

b) a side facing portion having a substantially constant second profile and adapted to be received in the forward facing portion, the side facing portion including a first longitudinally extending wall surface segment having a first longitudinal free edge and a second longitudinally extending wall surface segment having a second longitudinal free edge, the first segment and the second segment being disposed generally orthogonally to each other and the second segment being in planar contact with a terminating edge of a wall frame portion to create a nailing surface that is perpendicular to the outboard nailing flange and inboard nailing flange;

wherein the first longitudinally extending wall surface segment is disposed at least partially within the channel flange along substantially its entire length;

wherein an open space is defined behind the exterior stepped topography and forward of the first plane;

wherein the forward facing portion and the side facing portion have a substantially constant wall thickness less than about 5 mm throughout the entirety of their profiles; and wherein at least the forward facing portion includes a plurality of substantially continuous longitudinally disposed glass fibers in a thermoset polymeric matrix; and c) a corner joint facing portion having a substantially constant third profile and adapted to be received by the forward facing portion and the side facing portion and overlapping at least two of the three-dimensional edge cladding pieces;

i) the corner joint facing portion including a first joint longitudinally extending wall surface having a first joint longitudinal free edge, wherein the first longitudinal extending wall surface is mated to the second longitudinally extending wall surface segment;

ii) a second joint longitudinally extending wall surface segment.

* * * * *